United States Patent [19]

Gearhart

[11] Patent Number: 4,921,256

[45] Date of Patent: May 1, 1990

[54] CONTRASTED PROJECTILE TARGET AND METHOD OF MAKING SAME

[76] Inventor: Laird G. Gearhart, Apartment 10A, Wellington Arms Apartments, 103 Monica Dr., Greensburg, Pa. 15601

[21] Appl. No.: 256,852

[22] Filed: Oct. 12, 1988

[51] Int. Cl.[5] ..... F41J 5/00

[52] U.S. Cl. ..... 273/378

[58] Field of Search ..... 273/378, 26 A, 181 R

[56] References Cited

U.S. PATENT DOCUMENTS 1,175,692 3/1916 Boicourt ..... 273/378

3,330,561 7/1967 Kandel ..... 273/378

*Primary Examiner*—Anton O. Oechsle

*Attorney, Agent, or Firm*—Lawrence R. Burns

[57] ABSTRACT

Disclosed herein is a multi-sheet projectile target with a marking material that is captively held between a first sheet, which is a target face, and an elastic material located behind the target face. The marking material is selected to contrast with the front of the target face behind which it is located. A surface roughness, on one or both sides of the target sheet, is selected to co-operate with the marking material, so as to accept and retain the marking material on the target face sheet when portions of the target face sheet are exposed to the powdery form of the marking material.

42 Claims, 1 Drawing Sheet

CONTRASTED PROJECTILE TARGET AND METHOD OF MAKING SAME

BACKGROUND OF THE INVENTION

This invention has to do with ballistic targets and is especially concerned with firearms or other projectile targets where the projectile "hit" on the target is hard to see from a distance. More appropriately, this invention has to do with self-marking ballistic targets.

Ballistic targets are used in a wide variety of applications and most commonly when an individual practices or competes firing a weapon where a projectile is aimed at a particular target. When the weapon used is a bow and arrow it is usually easy for the individual firing the weapon to see not only if he hit the target but the approximate position on the target where the projectile struck. This provides valuable and immediate feedback to the individual practicing with the weapon so that he may correct any deficiencies in his aim at the target. In the instance where an arrow is the projectile it is the arrow itself that allows the individual to see where the target has been hit. When an individual is firing a weapon or other device where the projectile cannot be seen after it passes through the target, such as a firearm using bullets, then the hole in the target is the only evidence as to whether or not the target has been hit and also as to where the target has been hit. In such cases as firearms the individual practicing cannot see the evidence on the target and must unload his weapon and approach close to the target to get the necessary feedback so as to correct his aim. On firing ranges where other individuals are practicing also this means one must usually wait until all have quit firing to approach the target area. On some firing ranges, devices are present where the target is suspended on a wire and pulley assembly so that revolving the pulleys brings the target close to the individual for inspection.

Prior devices that have attempted to address the problem are more fully described in U.S. Pat. No. 3,330,561 to Kandel and in a non-analogous situation U.S. Pat. No. 1,175,692 to Boicourt. The Boicourt patent deals with baseball targets and therefore not with the type of problems addressed herein.

BRIEF SUMMARY OF THE INVENTION

According to the present invention there is disclosed a projectile target that is comprised of a target face, a contrasting marking material, elastic means behind said marking material which captively holds the marking material behind the target face, and a backing material located behind the elastic means and the target face.

The target face is preferably comprised of a paper material and most preferably is a standard weight drawing paper. The front of the target face has a bull's-eye painted or imprinted thereon and which may be of the standard variety or a design of any choosing. The front of the target face has imparted thereon also a means for accepting and retaining the contrasting marking material when it comes into contact with the target face. The preferable means for retaining the marking material is by an imparted surface roughness on the target face, which may be accomplished by selecting a standard weight drawing paper with enough tooth to hold the marking material selected. Other means may be employed, such as glues and adhesives that create a lightly sticking surface.

The marking material used herein is preferably a powdered chalk material of a color that contrasts with the background of the target face behind which it is placed. In its initial form the marking material may take any form, but after impact by the projectile or after the projectile has passed through the marking material there must then exist a powdered form of the marking material that can attach itself to the target face. Included in this category is the preferred form of the invention, a powdered chalk material that is a powder both before and after the projectile passes through the target. The marking material is preferably brushed or rubbed on to the rear of the target face and the excess powder allowed to remain. A glue means, preferably a universal rubber cement, is then applied around the outside edge of the chalk material on the backside of the target face and preferably over the marking material. The glue is then applied, preferably in beads of 1/32 inch wide, in a crosshatching manner over the rest of the marking material, so as to produce areas of preferably 9 square inches of marking material free from the glue material, and also creating air pockets between the back of the target face and the elastic material that will captively hold the marking material.

An elastic plastic material, preferably in sheet form, is then attached to the rear of the marking material and to the rear of the target face so as to captively hold the marking material behind the target face.

A backing material, preferably also of a standard weight drawing paper, (although it may be of any material of sufficient strength to provide the appropriate resistance behind the elastic plastic material), is then attached behind the target face and the elastic plastic material. The backing material may be attached directly to the rear of the target face, directly to the rear of the elastic plastic material, or to both. The structure will then resemble a sandwich affair with the target face and the backing material sandwiching the elastic plastic material and the marking means.

The present invention also contemplates the method of making a projectile target which comprises the steps of making a target face for a projectile, which includes placing a bull's-eye thereon or any other design for gauging the accuracy of a projectile "hit". The target face is selected or provided with a means for accepting and holding a powdered marking material on the target face, wherein the selection process may involve choosing a standard weight drawing paper having the appropriate tooth for holding the marking material or the target face may have imparted thereon a surface roughness designed to hold the marking material thereon.

The marking materials are then selected so that they will contrast markedly with the front of the target face and also be in a powder form after the projectile has passed through the target. The preferable material is a chalk material although it will be appreciated that other materials (such as a toner type material, or an ink type material) may be used.

The marking material is then brushed or rubbed onto the back of the target face and may be glued thereon in selected places with a preferably universal rubber cement.

An elastic plastic material is then attached to the rear of the target face and to the rear of the marking material so as to captively hold all the marking material behind the target face. The plastic material preferably has all the characteristics of GLAD large kitchen bags presently on the market. (GLAD is the trademark name).

Different colors of marking materials may be used in the center area of the target than in the surrounding areas of the target so that the marking material will contrast with the bull's-eye area and also with the predominantly white area surrounding the bull's-eye area. The marking material is preferably glued in place in selected areas using the universal rubber cement and then the plastic or elastic material is then placed over the areas that have both the glue and the marking material mixed.

It is an object of the present invention to provide a projectile target that makes it easier for one to see from a distance where the projectile has hit the target.

It is an object of the present invention to provide a projectile target that identifies by contrasting marking materials where a projectile has hit the target.

It is an object of the present invention to provide an efficient and easy to manufacture projectile target that has a highly visible means for marking where the projectile has hit the target.

It is a further object of the present invention to provide a projectile target that has marking means held captively thereon by an elastic means to provide for ease of identification of a target hit.

It is a still further object of the present invention to provide a projectile target that may be inexpensively manufactured and provide a highly visible means of identification of the projectile hit.

It is a still further object of the present invention to provide a method of manufacture of a projectile target that has a visible means of showing a projectile hit on the target.

It is a still further object of the present invention to provide a projectile target that automatically provides a contrasting marking color to the projectile perforation that can more easily be seen by an observer or actor on the firing line.

DETAILED DESCRIPTION OF THE DRAWINGS

DETAILED DESCRIPTION OF THE INVENTION

Figure 1:
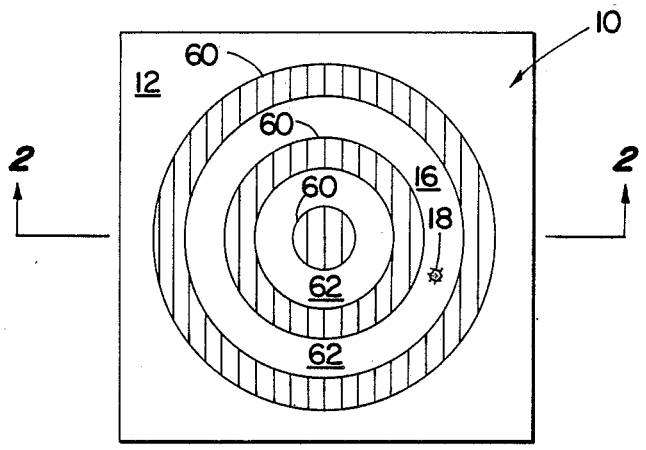
FIG. 1 is a front view of the projectile target according to the present invention.

Shown in FIG. 1 is a contrastable projectile scoring target 10 according to the present invention. The projectile target 10 has a target face 12 which faces the shooter or actor firing the projectiles. The face 12 may have imprinted or otherwise placed thereon a bull's-eye design of different colors as shown at 60 and 62. A projectile hole 18 is shown in FIG. 1 and is further described in FIGS. 3 and 4. The target face 12 is preferably comprised of a normal weight drawing paper and the rings of darker colors 60 may be placed thereon with india ink, although other methods of marking may be just as acceptable.

Figure 2:
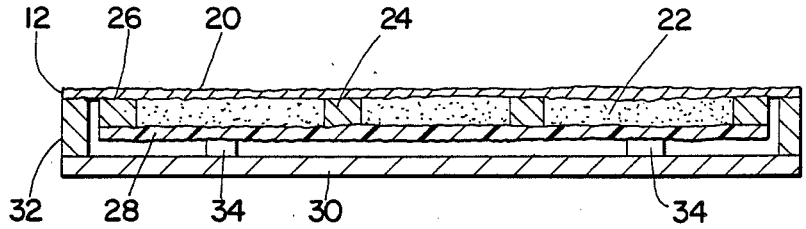
FIG. 2 is an enlarged view 2—2 shown in FIG. 1.

Shown in FIG. 2 is a cross-sectional view 2—2 of FIG. 1. The target face 12 is shown at the top of FIG. 2 and has imparted to its upper surface a surface roughness 20. When using a standard or other weight drawing paper, the paper may be selected so as to have a certain "tooth" which is a standard way of describing the surface roughness of the drawing paper. The surface roughness 20 or toothed arrangement is preferably on both sides of the target face 12. Shown immediately behind the target face 12 in FIG. 2 is a marking material 22, which preferably is comprised of a colored material that contrasts with the adjacent and immediate front of target face 12. As will be explained later there will also be sections of material 24 which comprises a mixture of the marking material and a glue material. There will also be sections 26 which may comprise a glue material by itself or the above mentioned mixture of marking material and glue material shown at 24. The marking material is selected so that it will preferably be in a powder form after the projectile has impacted and passed through the projectile target 10. In this particular embodiment the marking material is also in powder form before the projectile has passed through the target 10. The marking material used herein is a form of chalk material. Both the surface roughness 20 and the marking material 22 are selected so that they cooperate together in order that the target face accept and retain the marking material on the front surface of the target face 12 after the projectile has passed through the target 10.

Behind the marking material 22 is a sheet of elastic plastic material 28 that is held to the back of the target face 12 by either or both of the means of 24 and 26. The sheet or material 28 captively holds the marking material 22 immediately behind the target face 12. Because of the powdery nature of the marking material 22, there is also created somewhat of an air pocket between the target face 12 and the sheet of material 28. Located directly behind the sheet of material 28 is a backing material 30 that is believed necessary to impart strength to the sheet material 28 and the target face 12. The backing material 30 is also comprised of a standard weight drawing paper although it may be comprised of any inexpensive material of sufficient strength for its purpose. The backing 30 may be attached to the rear of the target face 12 as at 32 with a glue material and/or attached to the back of the sheet material 28 as at 34 with a glue material.

Figure 3:
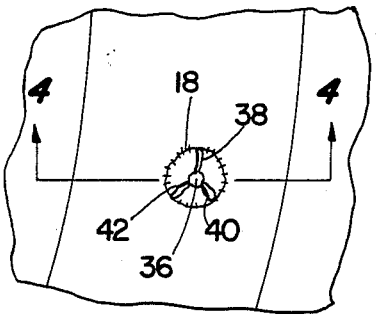
FIG. 3 is an enlarged front view of a projectile "hit" on the projectile target according to the present invention.

Shown in FIG. 3 is a portion of the target face 12 shown in FIG. 1 and having a projectile hole 18 therein. The projectile hole 18 is shown on the lighter or white colored portion 62 of projectile target 10 although it is to be understood that the projectile hole 18 could be shown in white on the darker or black section 60 of the projectile target 10. The projectile hole 18 has shown a small center perforation 36 that is intersected by the three tears 38, 40, and 42 in the target face 12. The perforation 36 and the tears 38, 40, and 42 are a generalized portrayal of the hole that is usually created by the projectile passing through the target face 12.

Figure 4:
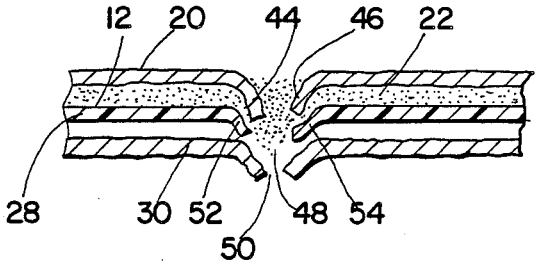
FIG. 4 is an enlarged view 4—4 shown in FIG. 3.

Shown in FIG. 4 is a sectional view 4—4 through FIG. 3 showing a further generalized portrayal of the "hole" left by the projectile as it passes through the target face 12. As can be seen flaps 44 and 46 of the target face 12 are drawn into the air and powder mixture region 22 as the projectile passes through the target 10. Because of the toothed surface roughness 20 on the target face 12 the marking powder will be accepted and retained on the target face 12 when the flaps 44 and 46 invade the region of the powdered material 22. The projectile of course creates perforations in the sheet material 22 and also in the backing material 30 as is shown at 48 and 50. The flaps 52 and 54 on the elastic material 22 immediately snap back to minimize perforation 48 after the projectile has passed therethrough, thereby helping to implode the marking material 22 back toward the target face 12 and create a contrasting mark thereon. The flaps 44 and 46 also move to minimize the perforation 40 shown in FIG. 3 and thereby expose portions of the flaps that carry marking material 22 thereon and which can then be more easily seen by the actor firing the projectile.

Figure 5:
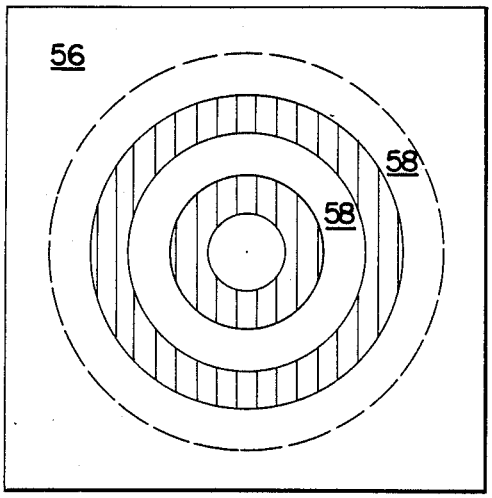
FIG. 5 is a rear view of the target face of the projectile target according to the present invention.

What is shown in FIG. 5 is the back side or face 56 of the target face 12 shown in FIG. 1. Contemplated also by this invention is the method of manufacture of the projectile target. As is shown in FIG. 5 the back 56 of the target face 12 has the powdered marking material 22 applied so as to contrast with the color on the adjacent and immediate front of target face 12. This is done by applying a light colored marking material as shown at 58 immediately behind the dark regions 60 of the bull's-eye configuration shown on the front face 12 in FIG. 1. A dark colored marking material 22 is then applied immediately behind the light colored regions 62 shown on the front face 12 in FIG. 1. The preferable method of application is to brush the marking material onto the surface in sufficient quantities to a preferable build-up of approximately 1/64 to 1/128 (estimated) inches in thickness. Thin furrows may then be made in the built-up chalk material so that the bead of glue may be placed in the furrow. As mentioned earlier the bead of glue is preferably 1/32 inch in width. Preferably the cross-hatched manner of applying the marking material will take the form of three inch squares, or squares of nine square inches, and the glue material will then be applied around the periphery of the squares, although the circular form of the bull's-eye in FIG. 5 may or may not accept such a pattern. In FIG. 5 the marking material is shown applied in circles and then the glue material is applied around the periphery of the colored marking materials. Preferably the glue material is a universal type rubber cement, and most preferably the rubber cement is a CAMEL brand rubber cement that is used for repairing bicycle tires. (This type of cement has been found to have the best ability to penetrate the powdered marking material and still attach to the back of the target face and to the elastic material). With the colored marking material in place and the glue material in place it has been found best to wait for a period of time so that the cement may set up or harden (usually about a minute). The elastic plastic backing material 30 may then be placed in contact with the glue over the back 56 so as to hold the colored marking material 22 captive against the back 56 of the target 10. (The approximate adhering time of the glue is 10 seconds and the drying time is 5 minutes.) When this is done it is then preferable to place glue or adhesive material on the front of the backing 30 in approximately the same pattern as on the target face. The areas where glue is applied to the backing material should preferably coincide with the areas of glue application on the back of the target face.

The target face and the backing material are preferably made of the same type paper or material and it has been found by experimentation that paper by the Mead Corporation of Dayton, Ohio, has worked rather well. The specifications for such paper are believed to be either a 72 pound weight, or a 50 pound weight paper, with a 175–185 smoothness from the Mead Corporation.

The cement preferably used is CAMEL Brand Cement 12-089 manufactured by the H. B. Egan Manufacturing Company of Muskogee, Okla., with the term CAMEL being the registered trademark of the company.

Through experience it has been found that wadd-cutters when used as projectiles may tend to punch a hole straight through the target of the present invention and therefore not leave a visible "spot" on the target.

It has further been found that any treatment of the target face with dye type materials that tend to make the paper brittle will downgrade the targets performance.

The present embodiments of this invention are thus to be considered in all respects as illustrative and not restrictive, the scope of the invention being indicated by the appended claims rather than by the foregoing description. All changes which come within the meaning and range of equivalency of the claims therefore are intended to be embraced therein.

I claim:

1. A projectile target which comprises:

a target face for making perforations therein with a projectile and comprising a paper material having a surface roughness thereon for accepting and retaining a powdered marking material;

a marking material comprising a material that produces a powdered substance after impact by a projectile;

elastic means behind said marking material for captively holding said marking material behind said target face; and, backing means comprising a paper material and located behind said elastic means.

2. The projectile target according to claim 1 in which said paper material comprises standard weight drawing paper with sufficient tooth to hold said powdered marking material on said target face.

3. The projectile target according to claim 2 in which said marking material comprises a powdered chalk material.

4. The projectile target according to claim 3 which further comprises glue holding said elastic means to the back of said target face.

5. The projectile target according to claim 4 which further comprises glue holding portions of said chalk material to the back of said target face.

6. The projectile target according to claim 3 which further comprises glue holding said elastic means to the back of said target face and said glue holding portions of said chalk material to the back of said target face.

7. The projectile target according to claim 6 in which said glue comprises a universal rubber cement.

8. The projectile target according to claim 7 which further comprises said chalk material applied to the center area of the rear side of the target face being of one color and the chalk material applied outside the center area on the rear side of said target face being of a different color than said one color.

9. The method of making a projectile target which comprises:

a. making a target face for a projectile;

b. providing means on the target face for holding a powdered marking material on said target face;

c. selecting a marking material that will contrast with the target face and be in a powder form after the projectile passes through said marking material;

d. locating the marking material on the rear side of said target face and using a universal rubber cement to hold portions of said marking material to the back of said target face;

e. attaching an elastic material behind said target face and said marking material so as to captively hold said contrasting marking material behind said target face;

f. providing a backing material behind the elastic material.

10. The method according to claim 9 which further includes using a universal rubber cement to hold portions of said marking material to the back of said target face.

11. The method according to claim 10 which further includes applying said universal cement to portions of said marking material on the back side of said target face and adhering said elastic material to said portions of said marking material and said rubber cement.

12. A projectile target which comprises:

a. a target face for making perforations therein with a projectile and comprised of a paper material having a surface roughness thereon for accepting and retaining a powdered marking material;

b. a marking material comprising a material that produces a powdered substance after impact by a projectile;

c. elastic means behind said marking material for holding said marking material behind said target face;

d. backing means located behind said elastic means.

13. The projectile target according to claim 12 in which said paper material comprises a standard weight drawing paper with sufficient tooth to hold said powdered marking material on said target face.

14. The projectile target according to claim 13 in which said marking material is comprised of a chalk material.

15. The projectile target according to claim 14 which further comprises a glue material holding said elastic means to the back of said target face.

16. The projectile target according to claim 15 which further comprises a glue material holding portions of said chalk material to the back of said target face.

17. The projectile target according to claim 16 in which said glue material is comprised of a universal rubber cement.

18. The projectile target according to claim 17 which further comprises said chalk material applied to the center area of the rear side of the target face being of one color and the chalk material applied outside the center area on the rear side of said target face being of a different color than said one color.

19. A projectile target which comprises:

a. a target face comprised of a paper material for making perforations therein with a projectile and having means thereon for accepting and retaining a powdered marking material;

b. a marking material comprising a material that produces a powdered substance after impact by a projectile;

c. elastic means behind said marking material for holding said marking material behind said target face;

d. backing means comprised of a paper material and located behind said elastic means.

20. The projectile target according to claim 19 which further comprises said elastic means captively holding said marking material behind said target face.

21. The projectile target according to claim 19 in which said marking material comprises a chalk material.

22. A projectile target which comprises:

a. a target face for making perforations therein with a projectile;

b. means on said target face comprising a glue material for holding a powdered marking material on said target face;

c. a marking material that contrasts with, and is located behind, said target face, said marking material forming a powdered material after impact by a projectile;

d. an elastic material located behind said target face so as to captively hold said contrasting material behind said target face.

23. The projectile target according to claim 22 in which said target face and said backing are comprised of a paper material.

24. A projectile target which comprises:

a. a target face comprised of a paper material for making perforations therein with a projectile and having means thereon for accepting and retaining a powdered marking material;

b. a marking material comprising a material that produces a powdered substance after impact by a projectile;

c. elastic means behind said marking material for holding said marking material behind said target face;

d. backing means located behind said elastic means.

25. A projectile target which comprises:

a. a target face for making perforations therein with a projectile and having means thereon for accepting and retaining a powdered marking material;

b. a marking material comprising a material that produces a powdered substance after impact by a projectile;

c. a sheet of elastic means behind said marking material for holding said marking material behind said target face and between said target face and said elastic means;

d. backing means located behind said elastic means.

26. The projectile target according to claim 25 in which said target face is comprised of a paper material.

27. The projectile target according to claim 26 in which said means on said target face for accepting and retaining said powdered substance comprises a surface roughness imparted to said target face.

28. The projectile target according to claim 26 in which said means for holding a powdered material on said target face comprises a glue material.

29. The projectile target according to claim 27 to which said paper material comprises a standard weight drawing paper with sufficient tooth to hold said powdered marking material on said target face.

30. The projectile target according to claim 29 in which said marking material is comprised of a chalk material.

31. The projectile target according to claim 30 which further comprises a glue material holding portions of said chalk material to the back of said target face.

32. The projectile target according to claim 31 which further comprises a glue material holding said elastic means to the back of said target face.

33. The projectile target according to claim 32 in which said target face and said backing are comprised of a paper material.

34. A projectile target which comprises:

a. a target face for making perforations therein with a projectile and having means thereon for accepting and retaining a powdered marking material;

b. a marking material comprising a material that produces a powdered substance after impact by a projectile;

c. a plastic sheet of elastic means behind said marking material for holding said marking material behind said target face and between said target face and said elastic means;

d. backing means located behind said elastic means.

35. The projectile target according to claim 34 in which said target face is comprised of a paper material.

36. The projectile target according to claim 35 in which said means on said target face for accepting and retaining said powdered substance comprises a surface roughness imparted to said target face.

37. The projectile target according to claim 35 in which said means for holding a powdered material on said target face comprises a glue material.

38. The projectile target according to claim 36 in which said paper material comprises a standard weight drawing paper with sufficient tooth to hold said powdered marking material on said target face.

39. The projectile target according to claim 38 in which said marking material is comprised of a chalk material.

40. The projectile target according to claim 39 which further comprises a glue material holding portions of said chalk material to the back of said target face.

41. The projectile target according to claim 40 which further comprises a glue material holding said elastic means to the back of said target face.

42. The projectile target according to claim 34 in which said target face and said backing are comprised of a paper material.

* * * * *